United States Patent [19]

Burkhardt

[11] Patent Number: 4,707,578

[45] Date of Patent: Nov. 17, 1987

[54] KEY OPERATED PRINTED CIRCUIT SWITCH

[75] Inventor: Gottfried Burkhardt, Winkelhaid, Fed. Rep. of Germany

[73] Assignee: Triumph-Adler A.G., Fed. Rep. of Germany

[21] Appl. No.: 811,437

[22] Filed: Dec. 20, 1985

[30] Foreign Application Priority Data

Feb. 14, 1985 [DE] Fed. Rep. of Germany ..... 3505033

[51] Int. Cl.[4] ..... H01H 1/24; H01H 1/50; H01H 13/00

[52] U.S. Cl. ..... 200/159 A; 200/5 A; 200/340; 200/250; 200/290

[58] Field of Search ..... 200/159 A, 5 A, 5 R, 200/292, 340, 290, 245–247, 250, 267, 302.2, 159 R

[56] References Cited

U.S. PATENT DOCUMENTS

| | | | |
|---|---|---|---|
| 3,870,840 | 3/1975 | Rivetta et al. | 200/5 A |
| 4,029,916 | 6/1977 | Chu | 200/5 A |
| 4,084,071 | 4/1978 | Smith | 200/5 A |
| 4,099,037 | 7/1978 | Hartzler et al. | 200/5 A |
| 4,138,604 | 2/1979 | Harmsen et al. | 200/267 |
| 4,243,852 | 1/1981 | Larson | 200/5 A |
| 4,341,934 | 7/1982 | Muller | 200/159 A |
| 4,398,074 | 8/1983 | Danielson et al. | 200/302.2 |
| 4,400,596 | 8/1983 | Fukukura et al. | 200/5 A |
| 4,480,937 | 11/1964 | Eckhardt | 200/159 A X |
| 4,608,465 | 8/1986 | Harada | 200/5 A |

FOREIGN PATENT DOCUMENTS

| | | | |
|---|---|---|---|
| 3047634 | 10/1981 | Fed. Rep. of Germany | 200/159 A |
| 3036336 | 4/1982 | Fed. Rep. of Germany . | |
| 3122517 | 5/1982 | Fed. Rep. of Germany . | |
| 2441260 | 7/1980 | France | 200/159 A |

*Primary Examiner*—Stephen Marcus
*Assistant Examiner*—Ernest G. Cusick

[57] ABSTRACT

A key operated switch for keyboards having a layer type construction of key support carrying printed circuits arranged to facilitate fully automatic production of keyboards. Further, the simple formation of a leaf spring, a key guide and the key stem comprising the switch enables these parts also to be assembled by machine. The simple and hence inexpensive manufacture of a keyboard utilizing the key operated switches causes no loss of operating quality.

4 Claims, 1 Drawing Figure

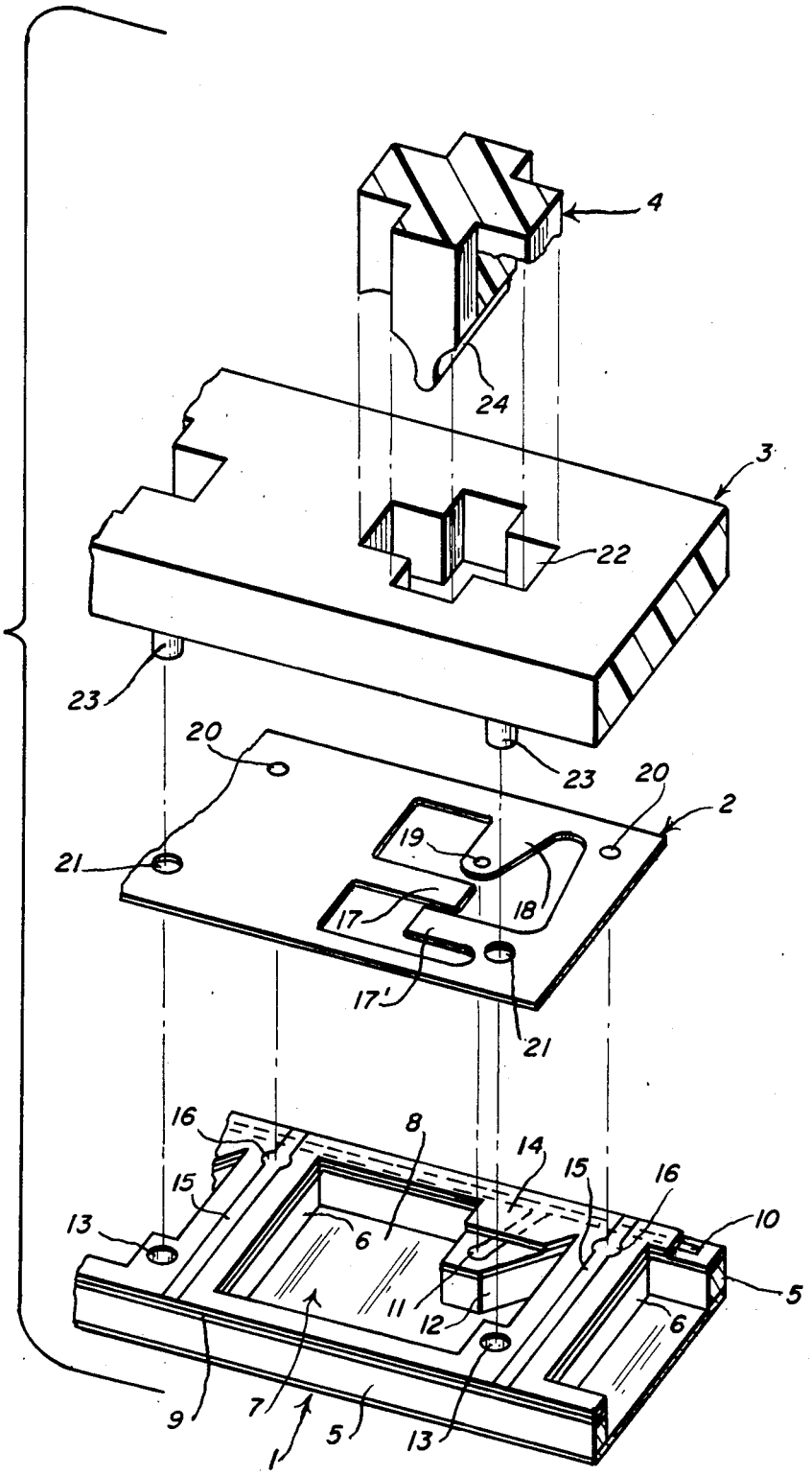
4
24
3
22
23
23
20
20
2
21
19
18
17
17'
21
16
8
14
15
16
15
13
6
10
5
11
12
6
9
7
5
13
1

KEY OPERATED PRINTED CIRCUIT SWITCH

BACKGROUND OF THE INVENTION

1. Field of the Invention

This invention relates to key operated switches for keyboards, more particularly it relates to key operated switches having printed circuit conductors and contacts.

Key operated switches are needed in a plurality of equipments, as separate parts, or assembled as a keyboard. Electronic typewriters and data processing equipments especially require such keyboards in large quantities. Consequently, such keyboards should not only be inexpensive to manufacture but at the same time should be reliable in operation at a very high speed and be protected from accumulation of dirt.

2. Description of Related Art

A relatively simple key operated switch is disclosed in DE No. 30 36 336 C2. There a spring is described which has three tongues, two of which serve as a return spring for the key and one as contact spring. This arrangement permits an especially flat construction combined with the required deep depression of the keys. With this known key it is possible to obtain a durable reliably working keyboard, but due to its construction largely automated manufacture is not possible making it relatively expensive.

Known foil keyboards, e.g., as disclosed in DE No. 31 22 517 A1, are too expensive per se and, as is generally known, they have the disadvantage of a reduced contact cycle number, whereby switch life is very limited.

SUMMARY OF THE INVENTION

In accordance with the invention a keyboard is characterized by planar key guide mountable on a planar key support whereon two printed circuits separated by a insulating layer are supported, and by a planar leaf spring sandwiched between the key guide and key support which functions as a key return spring and as a movable contact element bridging contacts on conductors of the two printed circuits upon depression of a key.

The manufacture of the key support can be practically fully automatic. Also, insertion of the leaf spring and positioning of the key guide with a key stem can be a machine operation. The manufacturing costs are thereby substantially reduced, especially for large quantities; yet a keyboard of good operating quality is produced which is in no way inferior to other, more expensive keyboards.

In accordance with the invention conductors on each printed circuit are preferably arranged in X and Y coordinates to facilitate provision for necessary electrical connections thereto. The formation of the contact points with durable coatings assures good contact-making combined with long life. To this long life the features of a closed housing contribute.

An object of the invention is to provide switches for keyboards characterized by long life and which to a large extent permit automated manufacture.

Another object of the invention is in the provision of key switches in a keyboard having an interface between man and machine which is pleasing to the touch and provides for pleasant deep key depressions.

Other objects, features and advantages of the present invention will become better known to those skilled in the art from reading the following detailed description when taken in conjunction with the accompanying drawing wherein like reference numerals designate like or corresponding elements throughout the several views thereof and wherein:

BRIEF DESCRIPTION OF THE DRAWING

The single FIGURE in the drawing is an exploded perspective view of an embodiment of a key switch in accordance with the invention.

DESCRIPTION OF PREFERRED EMBODIMENT

Referring now to the drawing there is shown a key switch comprising a planar frame-like key support 1, a leaf spring 2, a key guide 3 and a key stem 4, all of which will be described below specifically and in their interaction.

The planar frame-like key support 1 which may be formed of metal or plastic comprises parallel upper and lower walls 5 and side walls 6 forming a box-like compartment 7. A plurality of box-like compartments 7 for accommodating a plurality of key supports 1, corresponding to the number of key switches desired, may be integrally formed as shown. If the key support 1 is formed of plastic, the bottoms 8 of the compartments 7 can be produced in one piece with the key support 1. If the key support 1 is formed of metal, the bottoms 8 may consist of a foil applied, e.g. glued, on the underside of key support 1. Thus the key support 1 can be designed for a single key or for a whole keyboard for use in telephone sets, typewriters or data processors.

The the top surface of the upper wall 5 of the key support 1 must be electrically non-conductive. To this end, in case of a metal key support 1, as shown in the figure, an insulating layer 9 may be applied. Onto this insulating layer 9 a conductor 10 is printed which extends parallel to the upper and lower walls 5. From the printed circuit conductor 10 a branch leads into each of the compartments 7, where it ends in the form of a contact point 11 on a projection 12 integrally formed on the key support 1. In the side walls 6 bores 13 are provided.

Overlying the printed circuit conductor 10 is an additional insulating layer 14 which, with the exception of the contact point(s) 11, covers the upper and lower walls 5 and side walls 6 of key support 1. On layer 14, overlying rungs 6, additional conductors 15 are printed extending crosswise to conductor 10. The conductors 15 may be provided with circular enlargements 16 serving as contact points. The insulating layers 9 and 14 may consist of foils or imprintable lacquer.

The leaf spring 2 is a flat metal conductor with cutouts defining three inwardly directed tongues 17, 17' and 18 formed by punching. The two tongues 17 and 17' serve as a return spring for they key stem 4. Tongue 18 serves as a movable contact element and is provided with a contact point 19 which is provided, as is also the contact point 11 on the conductor 10 on the key support 1, with a durable facing, e.g. gold or synthetic graphite ensuring good contact resistance. A small dent 20 on the leaf spring 2 provides, in the mounted state of the key switch, for good contact of the leaf spring 2 with enlargement 16 on the printed circuit conductor 15. At suitable marginal locations the leaf spring 2 is provided with one or two bores 21 matching those in the key support 1.

The key stem 4 has a cruciform cross-section, with a rounded portion 24 at its lower end. At its upper end, not visible in the drawing, the key stem 4 is provided with the usual key button (not shown) which may be integrally formed as one piece or be stuck on as a separate part.

The key guide 3 is preferably made of plastic. It has a cross-shaped cut-out 22, in which they key stem 4 is guided for longitudinal displacement. During mounting, the leaf spring 2 sandwiched between the key guide 3 and key support 1 can be fixed by means of one or more depending pins 23 located to pass through hole(s) 21 in leaf spring 2 and penetrate into the corresponding bore(s) 13 in the key support 1.

The assembly of the key switch or of a complete keyboard is very simple. The key support 1 with the insulating layers 9 and 14 with the printed circuit conductors 10 and 15 thereon respectively can be manufactured in an automated operation. After placing the leaf spring 2 on the key support 1 carrying printed layers 9 and 14, with tongues 17, 17' and 18 over the compartment 7 for interaction with key stem 4 the key stem 4 together with the key guide 3 is positioned so that the pin 23 engages through the hole 21 in leaf spring 2 and penetrates into the bore(s) 13 of the key support 1. The key guide 3 may be attached to the key support 1 by resilient hooks on the key guide 3 snapable in behind corresponding edges on the key support 1, or glued or welded to the key support 1, or attached by screws. The key guide 3 may also be designed so that it comprises several guides up to a complete keyboard.

In the mounted state, the tongues 17 and 17' press the key stem 4 upward by acting on of the rounded portion 24 thereof. A special stop to limit movement of the key stem 4 upwardly need not be provided if the switch is essentially designed as is disclosed in DE No. 30 36 336 C1. That is, by providing that the contact tongue 18 of leaf spring 2 protrudes into a transverse slit, not visible in the drawing, in the key stem 4. If then the key stem 4 is moved downward counter to the action of the tongues 17 and 17' of leaf spring 2, contact tongue 18 follows this movement until its contact point 19 bears on contact point 11 of conductor 10 thereby to close the circuit between the common conductor 10 and one of the printed circuit conductors 15. As key stem 4 is let go, the tension created in tongues 17 and 17' push key stem 4 upward again, so that tongue 18 detaches from contact point 11, thereby interrupting the circuit again.

On one outer edge of the key support 1, the common printed circuit conductor 10 and, on the edge at right angles thereto, the discrete conductors 15, may be brought out so that the necessary external electrical connections can be established there.

The coating and printing of the key support 1 can be carried out in the same manner as conventional printed circuit boards are produced. If the key support 1 is made of plastic, the insulating layer 9 can, of course, be omitted. In this case the common conductor 10 would be printed directly onto the upper surface of key support 1.

The invention claimed is:

1. A key operated switch for keyboards comprising a frame-like key support defining a compartment, a first printed circuit conductor on said key support, an insulating layer overlying said first printed circuit conductor except for a contact portion of said first printed circuit conductor, a second printed circuit conductor overlying said insulating layer a flat conductive spring overlying and contacting said second printed circuit conductor, said spring having a cutout defining a contact element and two return springs directed to overly said compartment for interaction with a depressible key stem, a key guide overlying said flat conductive spring, and a depressible key stem supported in said guide acting upon depression against said return springs and on said contact element to bring said contact element into contact with said contact portion of said first printed circuit conductor thereby to bridge said first and second printed conductors.

2. A key switch as recited in claim 1, said first printed circuit conductor extending in one direction and said second print circuit conductor extending in a direction at right angles to said first printed circuit conductor.

3. A key switch as recited in claim 1, said contact portion of the first printed circuit conductor as well as said contact element of said leaf spring having a durable facing ensuring a good contact resistance.

4. A key switch as recited in claim 1, said compartment formed by said key support having a bottom wall.

* * * * *